United States Patent [19]

Spengler

[11] Patent Number: 4,801,080

[45] Date of Patent: Jan. 31, 1989

[54] ICE CREAM CARTON

[75] Inventor: Daniel F. Spengler, Sacramento, Calif.

[73] Assignee: Deutchcube, Inc., Sacramento, Calif.

[21] Appl. No.: 932,335

[22] Filed: Nov. 19, 1986

[51] Int. Cl.[4] ..... B65D 5/02; B65D 5.68

[52] U.S. Cl. ..... 229/125.19; 229/132; 229/134; 229/165; 229/183; 229/905; 229/DIG. 12

[58] Field of Search ..... 229/3.1, 23 BT, 43, 229/134, 165, 182, 183, 905, DIG. 12, 23 R, 132, 133, 135, 136; 493/58, 62, 128, 129, 131, 133, 157

[56] References Cited

U.S. PATENT DOCUMENTS

| | | | |
|---|---|---|---|
| 2,351,166 | 6/1944 | Vergobbi | 229/132 |
| 2,443,531 | 6/1948 | Berch | 229/905 |
| 3,003,677 | 10/1961 | Hennessey | 229/134 |
| 3,197,109 | 7/1965 | Nelson | 229/134 |
| 3,679,048 | 7/1972 | Fujio | 229/DIG. 12 |
| 3,926,362 | 12/1975 | Beck et al. | 229/23 BT |
| 3,934,791 | 1/1976 | Dick et al. | 229/134 |
| 4,291,829 | 9/1981 | Vanderlugt, Jr. | 229/905 |
| 4,501,388 | 2/1985 | Cassidy | 229/134 |
| 4,530,461 | 7/1985 | Adamek | 229/134 |

FOREIGN PATENT DOCUMENTS

| | | | |
|---|---|---|---|
| 1092342 | 4/1955 | France | 229/134 |
| 1405596 | 9/1975 | United Kingdom | 229/132 |

OTHER PUBLICATIONS

Handbook of Corrugated Fibreboard Boxes & Products, 1968, p. 32, upper half (HSC).

*Primary Examiner*—Stephen Marcus
*Assistant Examiner*—Gary Elkins
*Attorney, Agent, or Firm*—Hill, Van Santen, Steadman & Simpson

[57] ABSTRACT

An ice cream carton is made as a perfect cube with six smooth, unbroken, external surfaces by forming aligned embossments and windows to facilitate adhesion of the carton walls without impairing the external unbroken smooth continuity.

5 Claims, 3 Drawing Sheets

ICE CREAM CARTON

BACKGROUND OF THE INVENTION

1. Field of the Invention

This invention relates generally to carton construction and especially ice cream packages and the method of making same.

2. Description of the Prior Art

Ice cream is generally packaged in a variety of different forms of packaging, some in the shape of tubs or pails or some in the form of cartons which are in different sizes and shapes, but most are rectangular in nature.

In such rectangularized carton constructions as are generally available, folding and locking flaps are provided so that at least the end walls of the carton or in some designs, the bottom wall of the carton is constituted by a plurality of interlocking flaps.

SUMMARY OF THE INVENTION

The present invention is characterized by a completely cubical package which is equal on all sides and is smooth and unbroken on all sides. Preferably, a removable lid is provided which fits with an interference fit. The carton thus provided has improved stress and crush resistance, utilizes the minimum space available for storage and transportation, and permits the ice cream contents of the content to harden up to 20% faster than in other forms of cartons due to equal exposure on all sides. The cubical configuration of the carton and the equal dimensions also greatly facilitates marking and display and provides a particularly attractive form of ice cream packaging with attendant marketing advantages.

DESCRIPTION OF THE PREFERRED EMBODIMENTS

Figure 1:
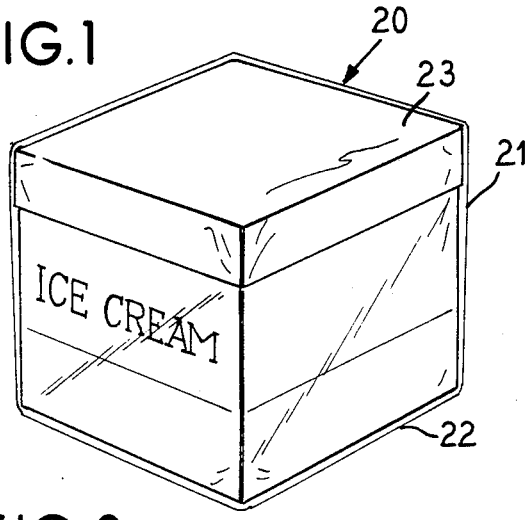
FIG. 1 is a perspective view of an ice cream carton made in accordance with the method of the present invention and embodying the principles of the present invention.

Although the principles of the present invention are applicable to a carton-type container suitable for various types of frozen edibles, a particularly useful application of the principles of the present invention are made to an ice cream carton and, accordingly, in describing an exemplary embodiment of the inventive features of the method and the carton made thereby, there is shown in FIG. 1 an ice cream carton in accordance with the present invention which is generally designated by the number 20. The carton is shown sealed in a shrink wrap 21 which is a thermal plastic layer of clear transparent material bonded in a single ply by heat sealing to completely encase the carton of the present invention.

The carton 20 has two principal components, namely, a body member shown generally at 22 and a cover member shown generally at 23.

Figure 2:
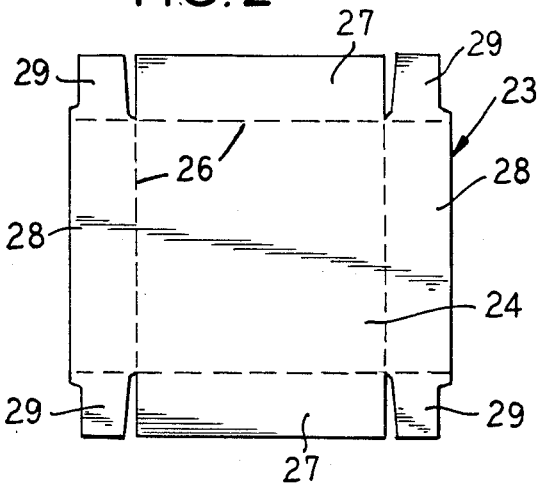
FIG. 2 is a development view of a sheet form member which is cut and scored to form a cover or lid.
Figure 5:
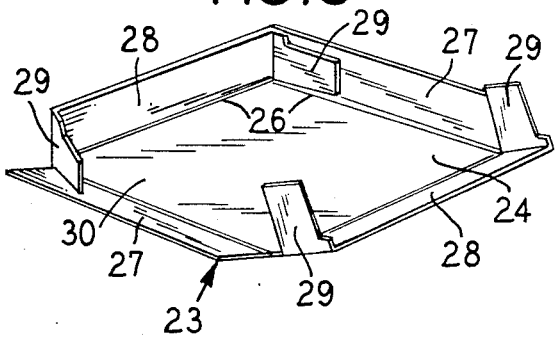
FIG. 5 is an intermediate assembly view showing how the cover of FIG. 2 is constructed and assembled.
Figure 6:
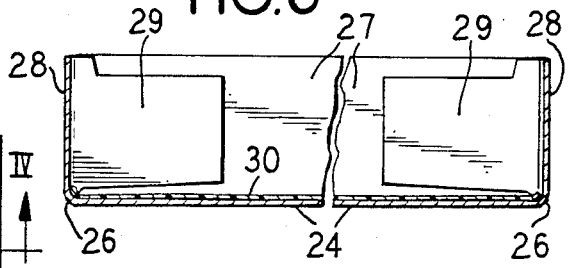
FIG. 6 is a framentary view partly in cross section showing additional details of the cover construction.
Figure 7:
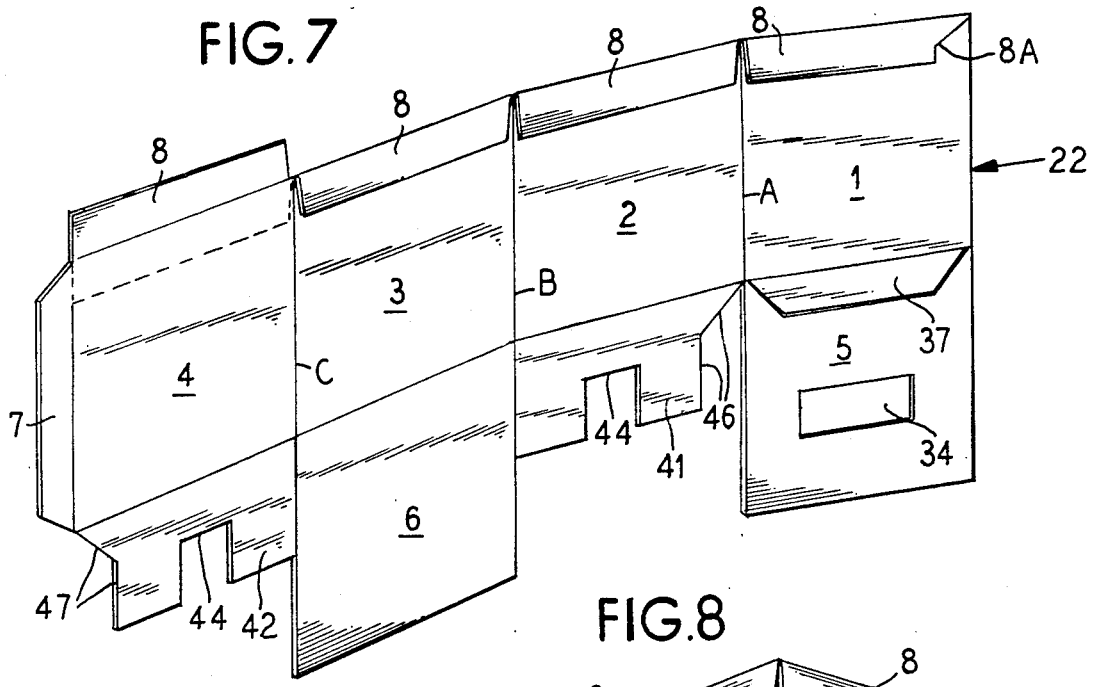
FIG. 7 is a view showing an intermediate assembly step in the formation of the ice cream carton using the body member of FIG. 3.

Referring first to all to the details of the cover construction, advantageous reference is made to FIGS. 2, 5 and 6.

The cover 23 is constituted by a sheet-form member made of stiff paper or chip board and may be calendered or prewaxed or poly coated as a matter of choice. The cover member in full developed exploded form is shown in FIG. 2 and constitutes a generally rectangular sheet-form member 24 roll scored as at 26 to form a square top wall bounded by four identical rectangular flanges each shown at 27 and 28, the flanges 28,28 having tabs 29,29 formed at each respective end thereof so that the flanges may be offset at the roll score lines 26,26 and the flanges 29,29 folded inside of the flanges 27,27. Each of the tabs 29 is secured by an adhesive joint between the laminates (not specifically visible) which places the flanges 28,28 and 29,29 in firm assembly with one another, thereby forming a complete flanged cover of lid 23.

The cover or lid 20 may be held together at the tabs 29 by hot melt adhesive, or a poly coating on the cover 23 may be provided which is then heat activated and pressed with the tabs 29 in proper adjacency to the flanges 27.

If desired, a thin layer of plastic forming a flavor seal 30 is adhered to the inside surface of the lid or cover 32.

Figure 3:
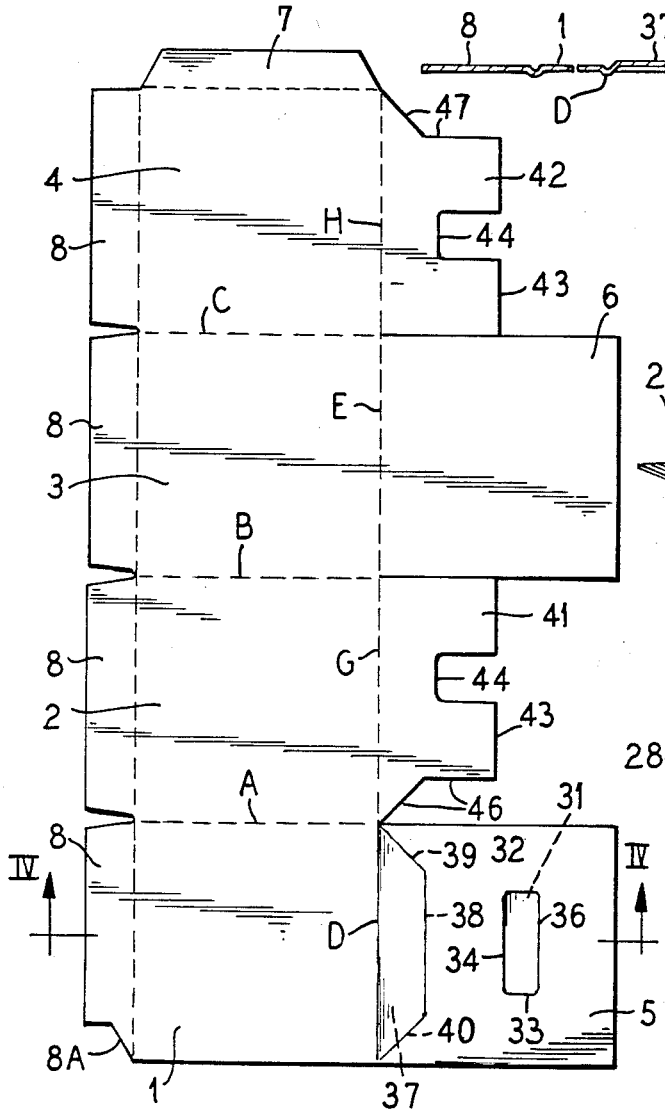
FIG. 3 is a development view of a body member provided in constructing the ice cream carton of the present invention.

The body member 22 of the ice cream carton 20 is shown in an exploded development form in FIG. 3 and constitutes a sheet-form body member made of stiff paper or chip board which may be poly coated or otherwise prewaxed to form a requisite surface for containing edible materials, in this instance, ice cream. More specifically, the sheet-form body member 22 is rolled and scored to provide 6 identically dimensioned square panels shown at 1, 2, 3, 4, 5, and 6. Four of the panels (1, 2, 3, and 4) are disposed in a longitudinal row in serial adjacency with one another and are interconnected to one another at three transverse roll score lines indicated at A, B, and C.

Two of the panels (5 and 6) are interconnected to two of the panels shown at 1 and 3 at longitudinal score lines designated at D and E.

One of the panels, namely, panel 4 has an assembly flap 7 which is adapted to be adhesively secured to an adjacent portion of the panel 1. Again, a separate adhesive joint may be provided or hot melt adhesive, or a poly coating may be provided which is then pressed and heat activated with the adjoining laminations in assembled alignment.

Each of the four panels, 1, 2, 3 and 4, are also provided on one longitudinal edge with a reinforcing flap 8. All of the reinforcing flaps 8 are rolled and sealed inside of the container formed by the body member when it is folded and formed into a rectangular tube with the assembly flap 7 underlying and secured to an adjacent portion of the panel 1. Thus, the reinforcing flaps 8 are rolled and sealed inside of the tube and help to keep the structure square and to eliminate bulge.

The reinforcing flap on the panel 1 is notched as at 8A to accomodate positioning of the assembly flap 7 on the inside surface of the panel 1.

Figure 4:
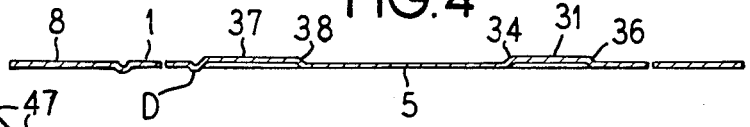
FIG. 4 is a cross-sectional view taken on line IV—IV on FIG. 3.

Referring now to the cross-section of FIG. 4 and in conjunction with FIG. 3, it will be noted that in accordance with the principles of the present invention, one of the panels, namely, panel 5, is provided with two separate anchoring embossments formed to extend outwardly of the flat plane of the panel 5. One of said embossments is shown at 31 and it will be noted that it is essentially rectangular in shape having two narrow ends 32 and 33 and two longitudinal sides 34 and 36. The generally rectangular anchoring embossment 31 is centrally disposed inwardly of the edges of the panel 5 and the length of the rectangle runs in a longitudinal direction.

The second anchoring embossment is shown at 37 and is formed in the panel 5 commensurate in length with the roll score D between the panel 1 and the panel 5. The embossment extends into the panel 5 inwardly of the roll score D, but terminates short of the anchoring embossment 31. Thus, the anchoring embossment 37 is an elongated strip having one edge prescribed by the roll score D and has an inside edge shown at 38. The ends of the embossment are angularly convergent and are shown at 39 and 40.

Two of the panels, namely, panel 2 and panel 4, each have a bottom wall half flap interconnected thereto at a longitudinal roll score line shown at G and H respectively. More specifically, each bottom wall half flap 41 and 42 has an innermost edge 43 centrally notched as at 44 so that the two bottom half flaps 41 and 42 together with one another will form an opening, 44,44, or window which is commensurate in size, shape and disposition with the anchoring embossment 31.

Additionally, the bottom wall half flap 41 is provided with a transverse notched edge as at 46 while the bottom half wall flap 42 is provided with a transverse edge notch 47 and such notched edges 46 and 47 are adapted to form an opening or window commensurate in size, shape and disposition with the anchoring embossment 37.

The purpose of the windows or openings, 44, 46 in the case of the bottom wall half flap 41 and 44, 47 in the case of the bottom wall half flap 42, is to provide "windows" permitting the panel 5 to be adhesively locked in firm assembly with the panel 6 when the body member 22 is folded and formed in the assembled relation, and which adhesion is effected as previously described.

Turning now to the sequence of illustrations shown in the drawings at FIGS. 7, 8, 9, 10, 11 and 12, FIG. 7 shows a beginning assembly operation wherein the body member 22 is positioned so that at the top of the structure, three of the flaps 8 have been already rolled over and the fourth flap 8 is about to be rolled over and sealed inside of the container to help keep the structure square and eliminate bulge.

Figure 8:
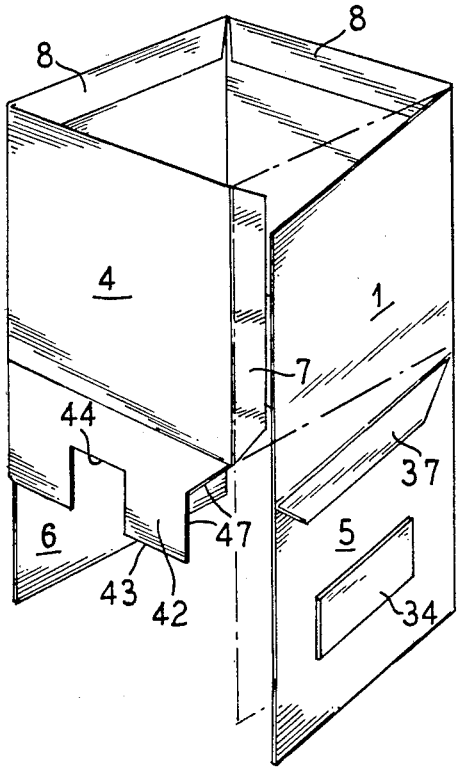
FIG. 8. is a subsequent assembly step in the formation of the carton of the present invention and using the body member of FIGS. 3 and 7.

In FIG. 8, the assembly flap 7 is folded on its score line and is positioned to underlie an inside adjacent surface of the panel 1.

Figure 9:
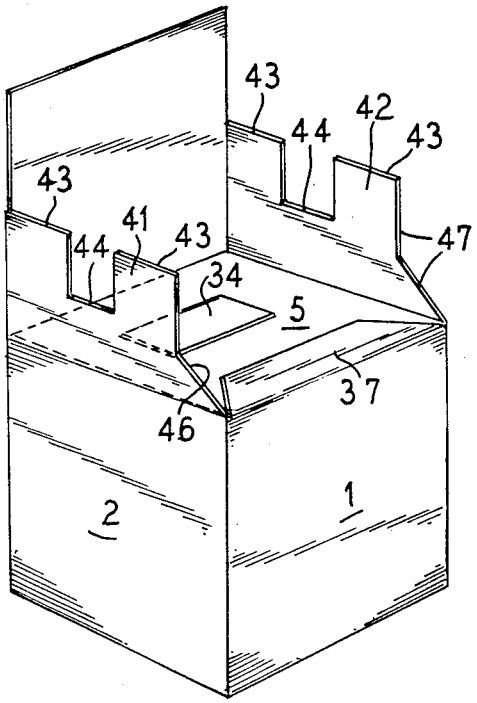
FIG. 9 is yet another sequential step in the formation of the ice cream carton.

In FIG. 9, the device is inverted to show additional details of the assembly. In this stage of the assembly, the panel 5 is folded down to form a completely extending sealing wall a cross the bottom of the rectangular tube, thereby providing a surface on which ice cream is received. Thus, the anchoring embossments 34 and 37 extend above the plane surface of the panel 1 in an upward direction using the orientation of FIG. 9.

Figure 10:
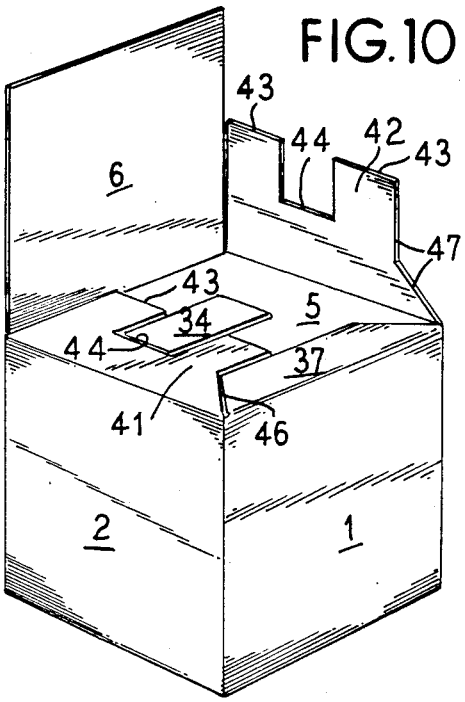
FIGS. 10, 11 and 12 show the final three stages of assembly formation of the ice cream carton using the body member of FIG. 3.

In FIG. 10, the bottom wall half flap 41 is folded over and is positioned so that the notched edge 43 approximately bisects the panel 5 and the notch 44 and the notch 46 clear the respective anchoring embossments 34 and 37.

Figure 11:
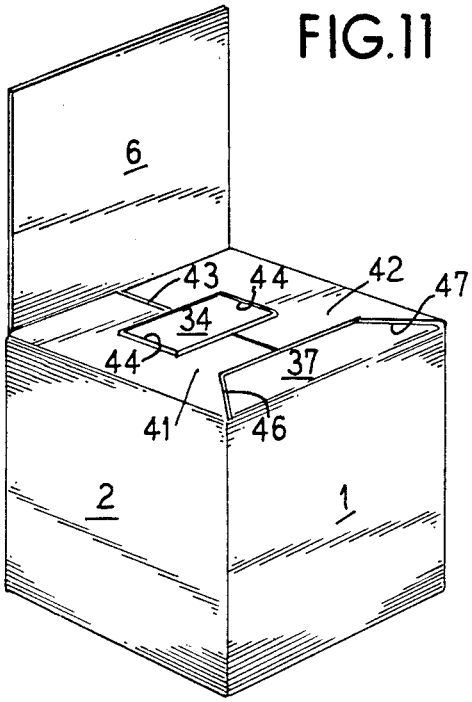

In FIG. 11, the other bottom wall half flap 42 is folded downwardly into adjacency with the panel 5. The notch 44, 47 provides "window" clearance for the anchoring embossments 34, 37.

The device is then ready for the final closure whereupon panel 6 is folded over to completely extend over and cover the subassembly represented by the half wall bottom panels 41 and 42 and the upstanding embossments 34 and 37.

Figure 12:
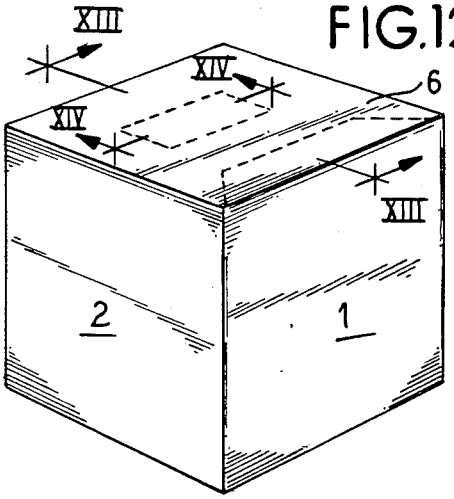
Figure 13:
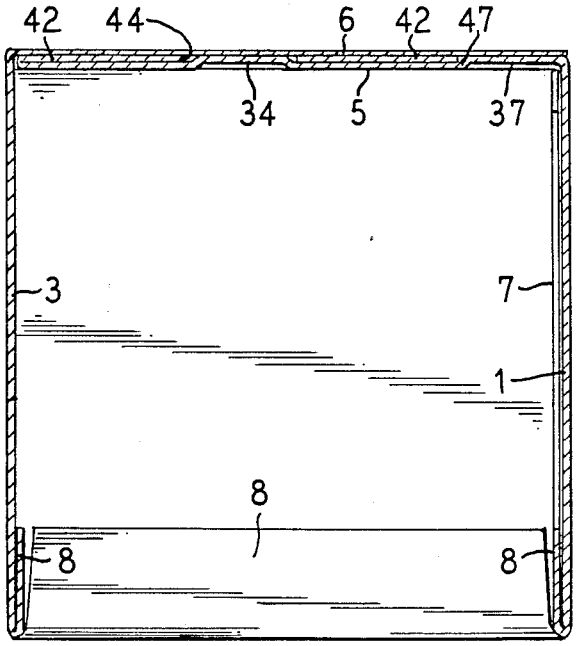
FIG. 13 is a cross-section view taken on line XIII—XIII of FIG. 12.
Figure 14:
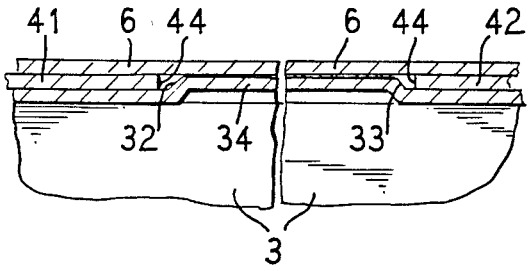
FIG. 14 is a fragmentary cross-sectional view taken on lines XIV—XIV to show additional details of the construction.

Either adhesive can be placed on the embosssment 34 and 37 to form a separate adhesive joint or as mentioned previously, the panel 6 can be firmly adhered to the anchoring embossments 34 and 37 by hot melt adhesive or the poly coating on the carton which has been heat activated and pressed. Thus, the finished body member has the panel 6 as shown in FIG. 12 wherein it completely overlies the subassembly represented by the bottom wall half panels 41 and 42 overlying the panel 5 and having its anchoring embossments 34 and 37 projecting upwardly through the windows of the notches 44, 46 and 47. The details of the connecting joints and the anchoring embossments are shown in the cross-section of FIG. 13 and the fragmentary cross-section of FIG. 14.

By virtue of the arrangement thus provided, the ice cream carton 20 is virtually a perfect smooth cube with identical sides and bottom wall. The cover 23 is a removable lid and is held in place by an interference fit.

The finished carton utilizes the minimum space available for storage and transportation and it has been found that ice cream will harden up to 20% quicker due to equal exposure on all sides in the cubical carton as disclosed. Additionally, the carton demonstrates great stress and crush resistance and affords an unusual configuration in that all six sides are characterized by smooth unbroken surfaces which facilitates affixation of trademarks and pictorial matter or other indicia on any and all sides of the carton and for that matter, even the bottom and top of the carton, since all six sides are smooth and all six sides are identically configured and sized and unbroken surfaces.

Although various minor modifications might be suggested by those versed in the art, it should be understood that I wish to embody within the scope of the patent warranted hereon all such modifications as reasonably and properly come within the scope of my contribution to the art.

I claim:

1. An ice cream carton comprising:

a sheet-form body member rolled and scored to provide six identically dimensioned square panels;

four panels of said six panels being disposed in a longitudinal row and being interconnected to one another at three transverse roll score lines and a remaining two panels of said six panels being interconnected to a first two of said four panels at longitudinal roll score lines;

a first panel of said four panels having an assembly flap and being interconnected thereto at a transverse roll score line;

whereby the body member may be folded and formed into a rectangular tube with said assembly flap adhesively underlying and secured to an adjacent portion of a fourth panel of said four panels;

each of said four panels having a reinforcing flap rolled and sealed inside of the tube to keep the structure square and to eliminate bulge;

the reinforcing flap on said fourth panel being notched to accommodate positioning of said assembly flap on said adjacent portion of said fourth panel;

one panel of the remaining two panels having edges and two separate anchoring embossments formed to extend outwardly of the plane of said one panel;

one of said anchoring embossments being generally rectangular and centrally disposed inwardly of the edges of said one panel;

the other of said anchoring embossments comprising an elongated strip commensurate in length with said roll score associated with the one panel and extending inwardly thereof, but terminating short of said one of said anchoring embossments;

a second two panels of said four panels each having a bottom wall half flap connected thereto at a longitudinal roll score line;

each of said bottom wall half flaps having an innermost edge centrally notched and together with one another forming an opening commensurate in size, shape and disposition with said one of said anchoring embossments; and each flap having a transverse edge notched to form an opening commensurate in size, shape and disposition with the said other of said anchoring embossments;

whereby said one panel may be folded to form an interior bottom wall and said half flaps may be folded to overlie said one panel and another panel of the two panels may be adhesively locked to said one panel at said anchoring embossments to form a smoothly surfaced cubical container having one open side; and a cover forming a top wall for the open side and comprising a cover panel of a size corresponding to each of said six panels and having cover reinforcing tabbed flanges rolled and sealed to form a continuous peripheral flange adapted to be placed in an interference fit assembly with the body member, thereby to form a cube having six essentially identical smooth sides.

2. An ice cream carton as defined in claim 1 and a clear thermal plastic shrink wrap completely surrounding the assembled body member and the cover.

3. An ice cream carton as defined in claim 1 and a sheet of flavor seal clear plastic material adhesively engaged with the inside surface of the cover panel.

4. An ice cream carton comprising:

a cubical body having an end wall, four side walls and an opened end of a square configuration; and a cover having a panel of the same size as the walls with a continuous peripheral flange;

said flange of the cover being removably fitted on said side walls adjacent the opened end to close said opened end;

said side walls being formed by four panels of a single thickness;

said end wall being formed by an inner panel, an outer panel, and two half panels connected to the four side walls;

said inner panel having two embossment means forming separate anchoring means with one anchoring means being at a center of the panel and another anchoring means being on an edge adjacent a side wall;

said half panels being cut and notched to provide a separate window to expose each of the anchoring means as the half panels cover the inner panel; and said outer panel being secured to the anchoring means exposed by said windows, whereby the body has five essentially identical, smooth external walls with an opened end closed by said cover.

5. A blank for a container which coacts with a cover to form an ice cream carton, said blank comprising:

a sheet-form member rolled and scored to provide four side panels and two bottom panels being identically dimensioned square panels;

said four side panels being disposed in a longitudinal row and being interconnected to one another at three transverse roll score lines and said two bottom panels being an inner panel with edges and an outer panel and being interconnected to a first two panels of said four side panels at longitudinal roll score lines;

a first side panel of the four panels having an assembly flap and being interconnected thereto at a transverse roll score line;

whereby the body member may be folded and formed into a rectangular tube with said assembly flap adhesively underlying and secured to an adjacent portion of a fourth side panel of said four panels;

each of said four side panels having a reinforcing flap adapted to be rolled and sealed inside of the tube to keep the structure square and to eliminate any bulge;

the reinforcing flap on said fourth side panel being notched to accommodate positioning of said assembly flap on said adjacent portion of said fourth side panel;

said inner panel having embossment means formed to extend outwardly of a plane of said inner panel to form anchoring means for securing the outer panel thereto;

said anchoring means having a first portion generally rectangular and centrally disposed and spaced inwardly of the edges of said inner panel;

said anchoring means having a second portion separate and spaced from the first portion, said second portion comprising an elongated strip commensurate in length with said roll score of the inner panel and extending inwardly thereof;

a second two panels of said four side panels each having a bottom wall half flap connected thereto at a longitudinal roll score line;

each of said bottom wall half flaps having notches in an innermost edge and a transverse edge, said edges of the flaps with the notches coacting together with one another to form two separate openings commensurate in size, shape and disposition with said first and second portions of the anchoring means with one opening for the first portion and another opening for the second portion;

whereby said inner panel may be folded to form an interior bottom wall and said half flaps may be folded to overlie said inner panel and said outer panel may be adhesively locked to said inner panel at said anchoring means to form a smoothly surfaced cubical container having one opened end.

* * * * *